US006206013B1

(12) United States Patent
Hörmann

(10) Patent No.: US 6,206,013 B1
(45) Date of Patent: Mar. 27, 2001

(54) DEVICE FOR CLEANING LAMELLAR BLINDS AND METHOD FOR USING THE SAME

(76) Inventor: Wolfgang Hörmann, Goldberger Strasse 20, D-19374 Zölkow (DE)

( * ) Notice: Subject to any disclaimer, the term of this patent is extended or adjusted under 35 U.S.C. 154(b) by 0 days.

(21) Appl. No.: 09/000,385

(22) PCT Filed: Jul. 30, 1996

(86) PCT No.: PCT/DE96/01411

§ 371 Date: Feb. 27, 1998

§ 102(e) Date: Feb. 27, 1998

(87) PCT Pub. No.: WO97/05816

PCT Pub. Date: Feb. 20, 1997

(30) Foreign Application Priority Data

Aug. 5, 1995 (DE) ..... 195 28 857

(51) Int. Cl.[7] ..... B08B 3/02
(52) U.S. Cl. ..... 134/25.4; 134/26; 134/42
(58) Field of Search ..... 134/25.1, 25.5, 134/29, 26, 186, 201, 198, 103.2, 103.3, 42, 10, 25.4

(56) References Cited

U.S. PATENT DOCUMENTS

| | | | | |
|---|---|---|---|---|
| 2,665,698 | | 1/1954 | Robinson | 134/88 |
| 2,682,676 | * | 7/1954 | Franchi | 15/77 |
| 3,314,819 | * | 4/1967 | Dyer | 134/6 |
| 5,021,097 | | 6/1991 | König et al. | 134/25.5 |
| 5,087,374 | * | 2/1992 | Ding | 210/673 |
| 5,876,516 | * | 3/1999 | Miller et al. | 134/37 |

FOREIGN PATENT DOCUMENTS

| | | | |
|---|---|---|---|
| 88 09 625 U | 5/1989 | (DE) | A47L/4/00 |
| 38 25 622 | 2/1990 | (DE) | A47L/4/00 |
| 295 11 546 | 11/1995 | (DE) | A47L/4/00 |
| 0 352 496 | 12/1993 | (EP) | A47L/4/00 |

* cited by examiner

*Primary Examiner*—Frankie L. Stinson
(74) *Attorney, Agent, or Firm*—Darby & Darby

(57) ABSTRACT

A method and device for cleaning vertically suspended lamellar blinds in collapsed state, is provided having a supply unit with a moveable supply container and functional elements for generating a fluid stream as well as a suspended spay device which is supported by the lamellae and comprises a spray head and a jacket foil enclosing the lamellar blind. The supply container is designed to be used separately with a washing solution or a rinse solution and is equipped with a pump, a pressurized line leading to the spray head and a return line. The pressurized line comprises a dual manifold disposed at the top and the return line has a connection at the top as well as a connection at the bottom.

2 Claims, 3 Drawing Sheets

Figure 1:
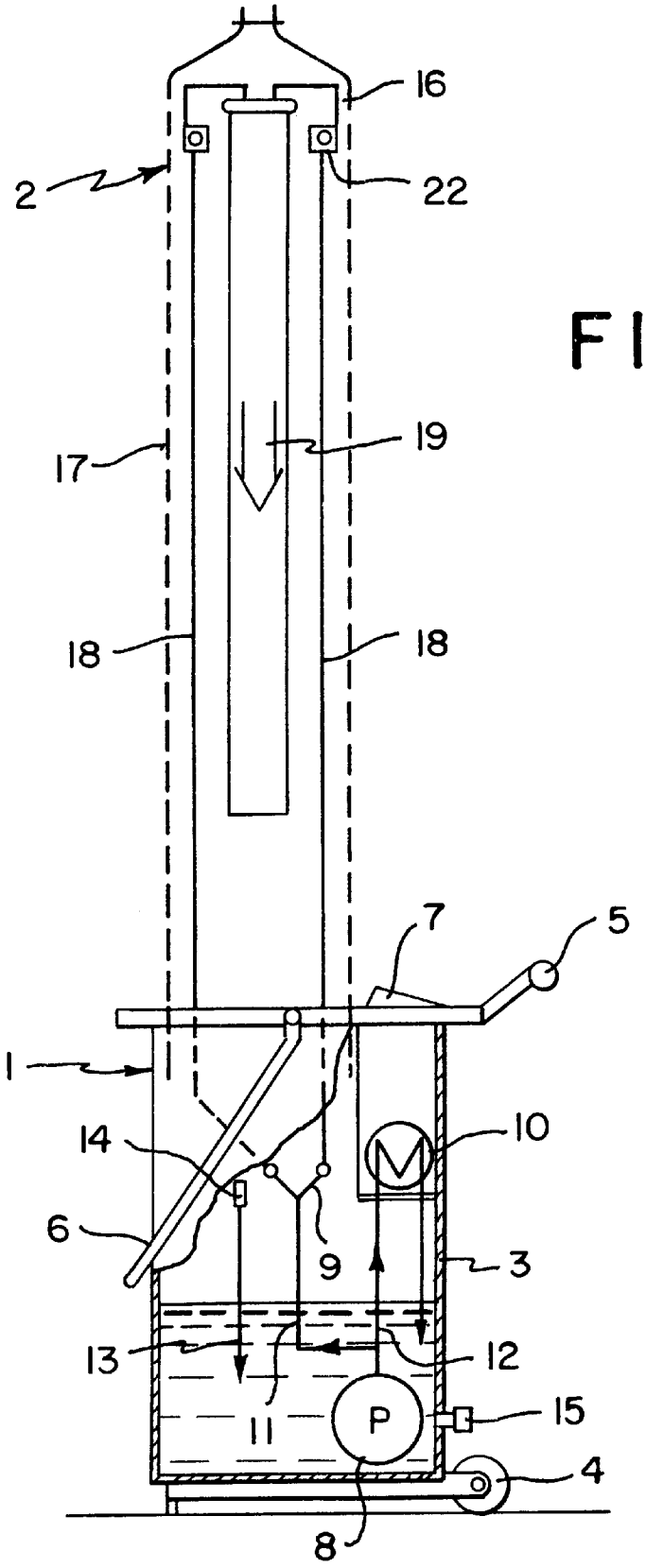

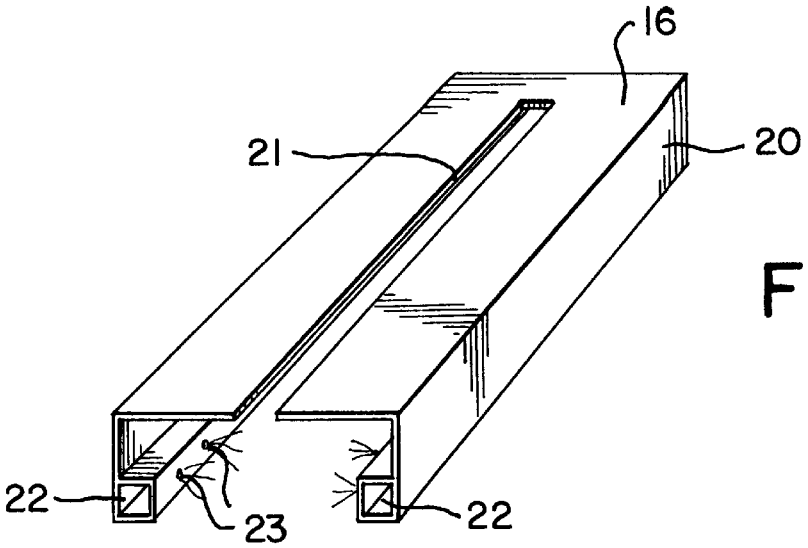
FIG. 3
FIG. 4
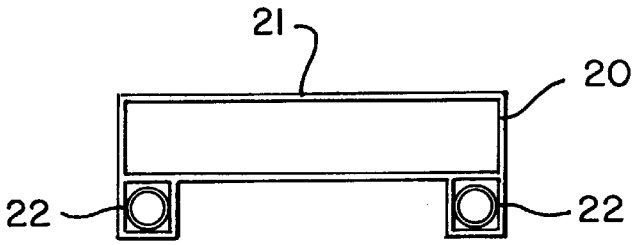
FIG. 5
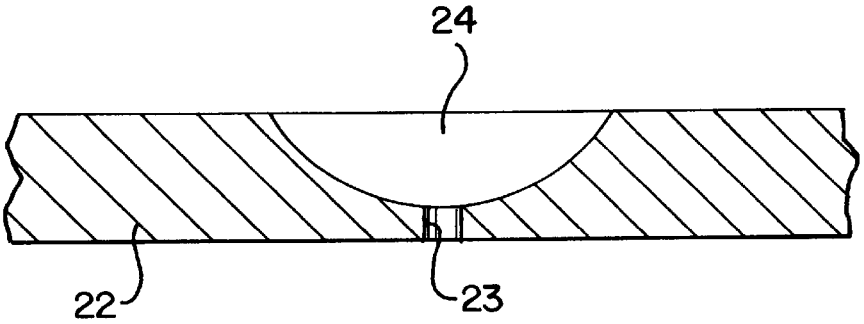

DEVICE FOR CLEANING LAMELLAR BLINDS AND METHOD FOR USING THE SAME

BACKGROUND OF THE INVENTION

The invention relates to a device for cleaning of vertically suspended lamellar blinds in the collapsed state. Devices of this type are used predominantly in the cleaning service industry.

Devices of this type are known in the art. The devices are basically comprised of a supply unit and a sprayer. The supply unit includes a moveable container which is equipped with several functional elements, such as a pump, a filter, a heater and respective control elements. The supply unit is connected through one or several connection lines with the sprayer which comprises a spray head with one or several nozzle bars and with a tube-like jacket foil.

A cleaning device is known wherein the described supply unit consists of a first and a second supply unit. The first supply unit includes the aforedescribed equipment found in a standard washing machine and is consequently filled only with a detergent solution. The second supply unit is also in the form of a moveable container and includes only a dedicated pump and a supply line which is connected to a distribution valve of the first supply unit. The second supply unit is constructed in the form of a rinsing machine and is thus filled with a rinse solution.

The lamellar blind is first washed for a certain time with the first supply unit. The detergent solution is fed to the spray head, where the solution emerges from the nozzles, runs down the lamellae and is then again collected with the open container of the first supply unit. For rinsing, the second supply unit is connected to the first supply unit. The rinse solution is here again fed to the spray head via the distribution valve of the first supply unit. The returning rinse solution is also discharged into the container of the first supply unit.

This device for cleaning of lamellar blinds is disadvantageous for several reasons. First, the design is rather complex, since each operation requires a supply unit of its own. This raises the cost of the whole cleaning device. Moreover, the operation of the device is complex and expensive. One of the two supply unit is always unused, since the second supply unit is not used during the washing operation and since the first supply unit is tied up during the rinsing operation and cannot be used for another lamellar blind. It is also disadvantageous that after the termination of the cleaning operation, the detergent solution and the rinse solution are intermixed in the container of the first supply unit and therefore cannot be reused for a subsequent cleaning.

From EP 352 496 B1 A, there is known cleaning device without some of these disadvantages. This device includes a dolly with supply containers for detergent solution and for rinse solution, respectively, as well as a pump and a heater. The dolly also includes a common supply container which can be set on the floor on location. When placed on the floor, the common supply container is filled from the appropriate feed container with either the detergent solution or the rinse solution. From here, the solution is conveyed to the spray head and then collected again as a dirty solution.

In order to drain the spent detergent solution, the supply container has to be raised above the level of the corresponding feed container. Thereafter, the supply container has to be positioned below the level of the other feed container in order to refill the supply container with the clean rinse solution.

Handling the feed containers is awkward and should be eliminated; moreover, handling is time-consuming and thus expensive. Moreover, the equipment required for each cleaning operation is too complex.

SUMMARY OF THE INVENTION

It is therefore the object to provide a device of the aforedescribed type of a simple and inexpensive design so that the detergent solutions and rinse solutions can be kept separate, and to develop an effective method for using such a device.

The object of providing such a device is solved by the characterizing features in that a supply container is designed to be used separately with a washing solution or a rinse solution and is equipped with, as is known in the art, with a pump, a pressurized line leading to a spray head and a return line, wherein the pressurized line comprises a dual manifold disposed at the top and the return line comprises a connection at the top as well as a connection at the bottom.

Other preferred embodiments include that the connection at the bottom in the return line is capable of being connected to a collection container placed low. Further, the a collection container is provided with a dual manifold. Further, the stray head included nozzle rails and each nozzle rail comprises a row of nozzle bores with an exit angle of about 90°. The nozzle bores are machined into the nozzle rail and surrounded by respective indentations.

The object of providing such a method is solved by providing first a first supply container containing the washing solution and a first sprayer is used with a first lamellar blind, that after the washing operation, the first supply container is disconnected from the first sprayer and used with a second sprayer on a second lamellar blind, and that simultaneously a second supply container of identical construction containing rinse solution is used with the first sprayer on the first lamellar blind.

The invention obviates the disadvantages of the present state of the art.

In particular, the detergent solution can be kept separate from the rinse solution. The solutions can thus be used several times, thereby reducing cost. Moreover, the design of the device is rather simple.

By making it feasible to use the same supply unit for the wash and rinsing operation, the acquisition costs of the device are reduced and handling of the device is simplified. The device can be used with great flexibility, thereby reducing the change-over times between the two cleaning operations.

Most advantageously, the rinse solution can be preheated.

Because of the simple design, the spray head can be operated rather easily and manufactured cost-effectively.

The invention is described hereinafter with reference to an embodiment.

BRIEF DESCRIPTION OF THE DRAWING FIGURES

Figure 2:
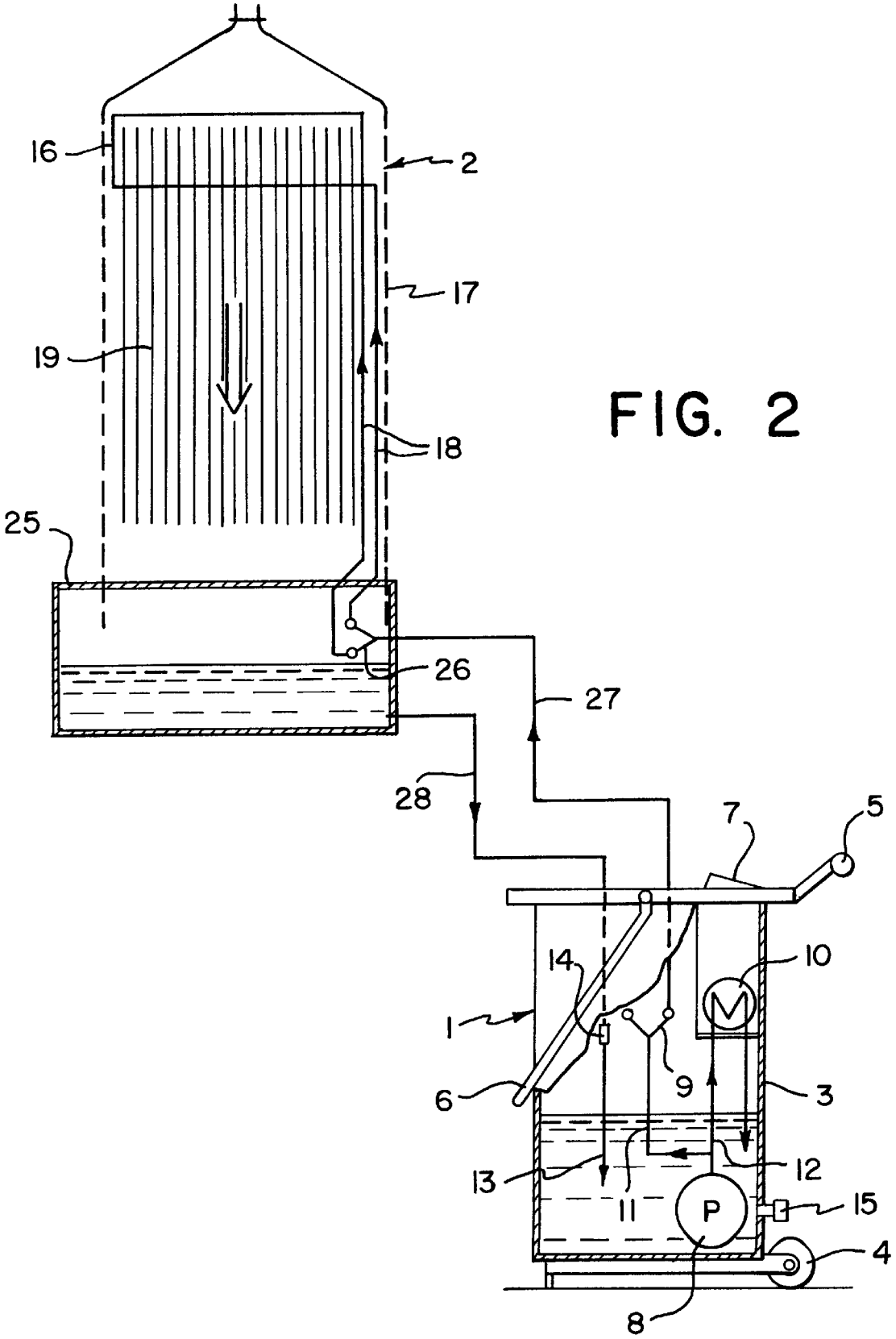

It is shown in:

FIG. 1 a diagram of the embodiment of the invention;

FIG. 2 a diagram of the embodiment of the invention with an additional collection container;

FIG. 3 a perspective view of a spray head;

FIG. 4 a view of a spray head;

FIG. 5 a cross section of a nozzle.

DETAILED DESCRIPTIN OF THE INVENTION

Referring now in particular to FIG. 1, the device for cleaning a lamellar blind is comprised of a supply unit 1 and a sprayer 2. The supply unit 1 is essentially in the form of a moveable supply container 3 which is also provided with two wheels 4 secured to an axle and at the top edge with a fixed handle 5 and a tiltable handle 6. The supply container 3 is kept open at the top and includes an operator console 7, a driven pump 8, a dual manifold 9 located at the top and a heater 10. The heater 10 is provided with a temperature safety switch which prevents the heater 10 and the pump 8 from operating if the supply container 3 is not filled. The pump 8 is directly connected to the manifold 9 via a pressurized line 11 and to the heater 10 via a bypass line 12. In addition, a return line 13 with an upper connection 14 and a lower connection 15 is also located in the supply container 3.

The sprayer 2 includes a spray head 16, a tube-like jacket foil 17 and two pressurized lines 18. The jacket foil 17 encloses the collapsed lamellar blind 19 in a water-tight manner. The spray head 16 is formed, as shown in FIGS. 3 and 4, by a rectangular prismatic base body 20 which is kept open towards the bottom and to one short side. The top surface is provided with a slot 21, with the open side of the slot 21 disposed on the open side of the base body 20. To each of the lower edges of the two long sides of the base body 20 there is secured a respective nozzle rail 22. The nozzle rail 22 is formed by a closed hollow profile body which is provided with a connection for the pressurized line 18 and with a row of evenly spaced nozzle bores 23. As illustrated in FIG. 5, the nozzle bores 23 are disposed on the respective inside of the nozzle rail 22, have an exit angle of about 90° and are enclosed by horizontal indentations 24.

Illustrated in FIG. 2 is a situation where the supply unit cannot be moved directly under the lamellar blind 19. This occurs, for example, if the lamellar blind 19 terminates on a window sill, a radiator or on the floor. In these situations, a separate collection container 25 has to be used. The collection container 25 has a dual manifold 26 which is connected to the manifold 9 of the supply container 3 via a pressurized line 27. The collection container 25 is also connected to one of the connections 14 or 15 of the supply container 3 via a return line 28.

For the cleaning operation, the lamellar blind 19 is first collapsed to form a block. Thereafter, the spray head 16 together with associated pressurized lines 18 is pushed over the lamellar blind 19 by guiding the base body 20 with the slot 21 past the vertical supporting rings of the lamellae and placing the base body 20 on the horizontal lamellae support. The jacket foil 17 is then pulled over the lamellar blind 19 and secured to the spray head 16. The supply container 3 is placed underneath the lamellar blind 19 and the pressurized lines 18 are connected to the manifold 9 of the supply unit 1. In this position, the jacket foil 17 extends into the open supply container 3.

The washing operation then begins. The pump 8 feeds the detergent solution through the pressurized line 11 via the manifold 9 into the pressurized lines 18. The detergent solution subsequently emerges from the nozzle bores 23, contacts the upper ends of the individual lamellae, runs down the lamellae and is collected again in the supply container 3. In parallel with this loop, detergent solution is circulated over the short distance through the heater 10 and thereby heated to the desired temperature.

After the washing operation is terminated, the pressurized lines 18 are disconnected from the manifold 9, and the supply container 3 is moved underneath a second lamellar blind 19. The second lamellar blind 19 is readied and washed with a second sprayer 2.

Meanwhile, a second supply container 3 which is filled with a rinse solution, is moved underneath the first lamellar blind 19 and connected to the pressurized line 18 of the first sprayer 2. The rinsing operation is performed in the same manner as the washing operation. In this way, the rinsing operation can optionally be carried out with cold or warm rinse solution.

Each lamellar blind 19 is cleaned by changing between a supply container 3 with detergent solution and a supply container 3 with rinse solution. Since the washing operation usually takes longer than the rinsing operation, and since it also takes longer to prepare for the washing operation, it is suggested to use for logistic reasons two or more supply containers 3 for the washing operation and the rinsing operation.

The required wash and rinse times alone determine the ratio of supply containers 3 for the washing operation to supply containers 3 for the rinsing operation.

List of Reference Numerals

1 supply unit
2 sprayer
3 supply container
4 wheels
5 fixed handle
6 tiltable handle
7 operator console
8 pump
9 manifold
10 heater
11 pressurized line
12 bypass line
13 return line
14 upper connection
15 lower connection
16 spray head
17 jacket foil
18 pressurized lines
19 lamellar blind
20 base body
21 slot
22 nozzle rail
23 nozzle bores
24 indentations

25 collection container
26 manifold
27 pressurized line
28 return line

What is claimed is:

1. A method for applying a device for cleaning of vertically suspended lamellar blinds in a collapsed state, wherein a detergent or rinse solution is conveyed from a supply container to a suspended sprayer, whereafter the lamellar blind is sprayed and the used solution is collected in the supply container, comprising the steps of:

utilizing a first supply container containing the washing solution and a first sprayer with a first lamellar blind;

disconnecting, after the washing operation, the first supply container from the first sprayer; and simultaneously using the first supple container with a second sprayer on a second lamellar blind, and a second supply container of identical construction containing rinse solution with the first sprayer on the first lamellar blind.

2. A method for applying a device for cleaning of vertically suspended lamellar blinds in a collapsed state, comprising the steps of:

connecting a first supply container containing a washing solution to a first sprayer;

washing a first lamellar blind using said first sprayer;

disconnecting, after washing said first lamellar blind, said first supply container from said first sprayer;

connecting said first supply container to a second sprayer;

connecting a second supply container containing rinsing solution to said first sprayer; and simultaneously washing a second lamellar blind using said first supply container with said second sprayer, while rinsing said first lamellar blind using said second supply container with said first sprayer.

* * * * *